United States Patent [19]

Hausberger et al.

[11] 4,005,996

[45] Feb. 1, 1977

[54] METHANATION PROCESS FOR THE PRODUCTION OF AN ALTERNATE FUEL FOR NATURAL GAS

[75] Inventors: Arthur L. Hausberger, Jeffersontown, Ky.; Gene A. Hammons, El Paso, Tex.

[73] Assignee: El Paso Natural Gas Company, El Paso, Tex.

[22] Filed: Sept. 4, 1975

[21] Appl. No.: 610,163

[52] U.S. Cl. ..... 48/197 R; 48/210; 260/449 M

[51] Int. Cl.[2] ..... C10J 1/00

[58] Field of Search ..... 260/449 M; 48/197 R, 48/210

[56] References Cited

UNITED STATES PATENTS

| | | | |
|---|---|---|---|
| 3,511,624 | 5/1970 | Humphries et al. | 260/449 M |
| 3,625,664 | 12/1971 | Padovani | 260/449 M |
| 3,854,895 | 12/1974 | Muller | 48/197 R |

*Primary Examiner*—Robert L. Lindsay, Jr.
*Assistant Examiner*—George C. Yeung

[57] ABSTRACT

A process is provided for the catalytic enrichment of a gas having a low BTU level and which has been derived from the gasification of coal and which has been scrubbed for removal of impurities and for the partial removal of carbon dioxide. The process involves the catalytic methanation of hydrogen and carbon oxides over a highly active catalyst in multiple stages to produce methane and steam. The cold scrubbed feed gas is brought up to reaction temperature by heat exchange with recycled product gas from the first stage of methanation, which in admixture with said feed gas acts additionally to modify the composition of said feed gas to bring it outside of the carbon forming range at the outlet of the reactor and to supply steam to said feed gas to prevent carbon deposition on to the catalyst and to absorb the heat of reaction. The enriched product gas after removal of water is interchangeable with natural gas and is of pipeline quality.

11 Claims, 3 Drawing Figures

METHANATION PROCESS FOR THE PRODUCTION OF AN ALTERNATE FUEL FOR NATURAL GAS

FIELD OF THE INVENTION

This invention relates to the catalytic enrichment of gaseous fuel having a low BTU level produced by gasification of coal and involves the reaction of the oxides of carbon with hydrogen over a highly active catalyst to produce methane and steam. More specifically, this invention relates to a process for the production of high BTU value methane of pipeline quality in which the residual carbon dioxide and hydrogen are consumed in the final stage of methanation to a level of less than 6 mole%.

BACKGROUND OF THE INVENTION

Production of gaseous fuel having a low BTU level by the gasification of coal has been known and practiced for many years. As practiced in Europe, a low BTU gas of about 500 BTU/per cu. ft. has been produced. Since the United States economy is based on a high BTU fuel such as natural gas, it is necessary to enrich low BTU gas so as to be interchangeable with natural gas. Further, the flame characteristics of the product gas must be equivalent to the flame characteristics of natural gas. Coal contains 5 wt. % hydrogen and 75% carbon whereas natural gas contains about 25 wt. % hydrogen. Thus, the conversion of coal to pipeline gas requires chemical addition of hydrogen to the coal molecule. Thus, it is necessary to subject a portion of the carbon monoxide in the coal gasification products produced in the gasification stage to shift conversion. The additional carbon dioxide produced in raising the concentration of hydrogen to a level stochiometrically sufficient to convert all of the carbon monoxide to methane must be removed at some point in the process. Additionally it is necessary to remove essentially all traces of sulfur compounds from the gases prior to passing the feed gas over the highly reactive, sulfur sensitive nickel catalyst. Since carbon dioxide acts as a diluent, its presence in the product gas is undesirable since it lowers the BTU value below that required. Further, the flame speed of the product gas is affected by the concentration of carbon dioxide and hydrogen. Many of the coal gasification processes under consideration effect the removal of acid gas prior to the methanation stage. Depending upon the process utilized, the removal of carbon dioxide may simultaneously effect a removal of sulfur and chloride impurities which are poisons for the nickel methanation catalyst and which must be removed under any circumstances. Removal of the acid gases at this point, then, is effective in removing sulfur impurities and eliminates the necessity of removing the carbon dioxide after the methanation step.

DESCRIPTION OF THE PRIOR ART

The utilization of steam to prevent carbon formation during catalytic methanation of carbon oxides is known and has been described in U.S. Pat. No. 3,511,624 to Humphries and Yarwood of the Gas Council relative to the production of methane from a synthesis gas obtained from the gasification of naphtha. Humphries and Yarwood explained the interrelation of steam, and carbon dioxide in the methanation reaction as follows:

"In catalytic gasification reactions involving carbon oxides, steam is used, as is known, to control the relative proportions of the monoxide and dioxide through the reaction $$CO + H_2O \rightleftharpoons CO_2 + H_2$$

so that the Boudouard reaction $$2\,CO \rightleftharpoons CO_2 + C$$

is prevented from moving to the right and causing carbon deposits and catalyst blockages. The minimum concentration of steam supplied to both stages of the process of the invention is such that when the gases reach equilibrium in the reactions $$CO + 3H_2 \rightleftharpoons CH_4 + H_2O$$

and $$CO + H_2O \rightleftharpoons CO_2 + H_2$$

there is a surplus of carbon dioxide over carbon monoxide in relation to the Boudouard equilibrium."

The teaching of Humphries and Yarwood, then, relative to the catalytic methanation of these synthesis gases is that a high concentration of carbon dioxide should be present during the methanation reaction in order to push the Boudouard reaction to the left. This, of course, involves the subsequent removal of carbon dioxide from the product gases.

Further, Percival, also of the Gas Council, discussed in U.S. Pat. No. 3,459,520 the recycling of wet and hot product gases to be admixed with the feed gases going to a naphtha gasification reaction. Insofar as methanation of carbon oxides from synthesis gas produced by coal gasification is concerned, the recycling of hot product gases was proposed as early as 1961 by Bienstock, Field, Forney and Demski in the Bureau of Mines Report Investigation 5841. In this hot gas recycle system, the temperature of the exothermic reaction was controlled by recycling 20 volumes of tail gas to the reactor inlet per volume of feed gas. Because of these voluminous quantities of recycle gas and the concomitant high level of power consumption, this approach was superceded by a tube wall reactor system which offers elimination of all or most of the gas recycle and a corresponding decrease in power consumption (See Field, Demeter, Forney and Bienstock, *I&EC PRODUCT RESEARCH & DEVELOPMENT*, pp. 150–152, Vol 3, No. 2, June 1964). In essentially all of the coal gasification processes presently under consideration, which include the early Lurgi gasification process, the Bi-Gas Process of Bituminous Coal Research, Consolidated Coal's $CO_2$ Acceptor Process and the Hygas process of the Institute of Gas Technology, part of the carbon dioxide is removed along with the other impurities prior to the methanation step. See "MAKE SNG FROM COAL?" by G. E. Klingman and R. P. Schaaf of the Fluor Corporation *HYDROCARBON PROCESSING* April, 1972.

However, in a paper presented by Moeller of Lurgi Mineraloetechink GMBH and Roberts and Britz, both of SASOL, Sasolburg, South Africa in the April, 1974 issue of *GAS PROCESSING*, a proposal reminiscent of Humphries and Yarwood involved the utilization of a surplus of carbon dioxide in the methanation step for the purpose of consuming the residual hydrogen in the product gas. Equilibrium considerations suggest that an increase in the concentration of steam in the inlet feed will increase the concentration of carbon dioxide in the product gas while a decrease in the steam concentration will tend to increase the hydrogen concentration of the product gases. For these reasons, many prior art proposals have involved the use of high steam and high carbon dioxide concentrations in the primary methanation step and the concomitant necessity of a final carbon dioxide removal step.

SUMMARY OF THE INVENTION

According to this invention, feed gases derived from the gasification of coal and in which acid gases such as carbon dioxide and other impurities have been partially removed by scrubbing are hydrogenated by reaction of carbon oxides and hydrogen to produce methane and steam in multiple stages. The last stage is designed to consume the residual carbon dioxide and hydrogen to such a level that the gas has a BTU value sufficiently high and is essentially interchangeable in composition with pipeline gas. The scrubbed gases are brought up to reaction temperature through heat exchange with a portion of the product gas from the first methanation stage. Further all of the steam required in the process is produced by gas recycled from the first stage of methanation and this steam is utilized to prevent carbon formation by controlling the relationship of the carbon oxides in the shift reaction and further to prevent upsetting the Boudouard equilibrium unfavorably. Additionally, the process steam absorbs the exothermic heat of reaction. We have found that in order to provide a product gas of high caloric value and of a composition interchangeable with natural gas, that both the concentration of carbon dioxide and the ratio of hydrogen to carbon monoxide in the scrubbed gases must be controlled within relatively narrow limits. Since the inlet gas composition is dependent upon the gas composition of the gas recycled from the outlet of the first stage of methanation (which supplies steam to the process) as well as the gas composition of the raw feed gas, close control of the gas composition of the raw feed gas and the gas composition at the inlet of each stage is required. However, with the proper gas compositions, all of the heat and all of the steam required for the process is provided by the recycled process gas. Auxiliary steam generators and auxiliary heaters are not required. The invention, then, involves methanation over a highly active methanation catalyst and recycling of less than six volumes of the hot and wet product gas from the first stage of methanation to one volume of feed gas to bring the feed gases up to reaction temperature, to control the equilibrium of the reactions favorably, to absorb the exothermic heat of reaction, and to modify the gas composition going to the first stage of methanation so as to produce a gas of high calorific value and having proper flame characteristics which is interchangeable with pipeline gas.

BRIEF DESCRIPTION OF THE DRAWINGS

Referring now to the drawings.

DESCRIPTION OF THE PREFERRED EMBODIMENT

Figure 1:
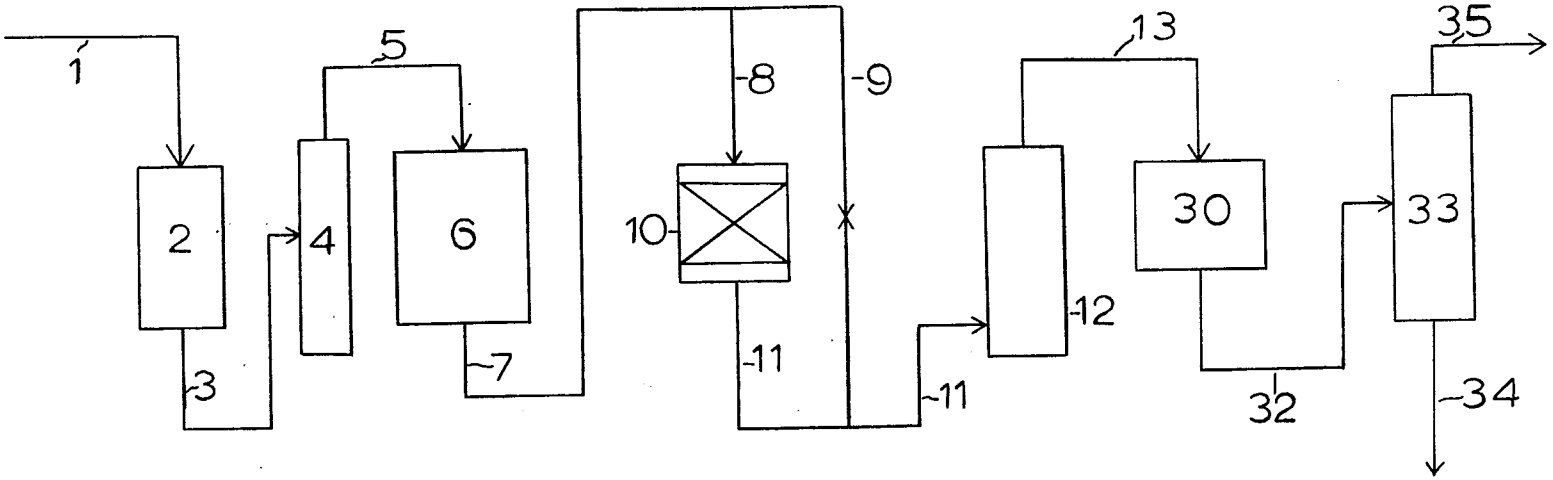
FIG. 1 PRIOR ART
FIG. 1 is a schematic drawing illustrating a generalized scheme for a combined coal gasification and methane enrichment process.

In the synthesis of methane from carbon oxides, there are five chemical reactions which may take place simultaneously. These reactions are as follows:

1. $Co + 3H_2 = CH_4 + H_2O - 94240$ BTU/lb. mol.
2. $CO_2 + 4H_2 = CH_4 + 2H_2O - 77{,}700$ BTU/lb. mol.
3. $CO + H_2O = CO_2 + H_2 - 16{,}500$ BTU/lb. mol.
4. $2CO = C + CO_2 - 37{,}277$ BTU/lb. mol. (BOUDOUARD REACTION)
5. $CH_4 = \text{Carbon} + 2H_2 + 36{,}222$ BTU/lb. mol.

As will be noted, the first two reactions are highly exothermic reactions of hydrogen with carbon oxides to form methane. The third reaction is the classical water gas shift reaction. The final two reactions are the two principal reactions by which carbon can be formed in the system. Carbon is a highly undesirable but potential product in the methanation stage. The exothermic nature of these reactions is a feature of major significance. Since the carbon monoxide concentration is high, it is necessary to provide a system which allows adequate heat removal. In conventional methanation, such as is used in production of hydrogen or ammonia synthesis gas, this is not a problem since methanation in these instances is used to remove a residual amount of carbon monoxide. However, since the highly active catalysts are sensitive to elevated temperatures, the temperature must be controlled to protect the catalyst and to provide conditions favorable for good catalyst performance and long catalyst life. In the coal gasification methanation system, all five reactions can occur. The rate at which each occurs is a function of process conditions, feed gas composition and the selective nature of the catalyst itself.

TABLE I below indicates typical gas compositions encountered with various processes. In typical hydrogen plants, it will be noted that the carbon monoxide concentration varies from 0.2 to 1.0 and a carbon dioxide concentration of 0.1 to 0.3. Additionally, there is a high concentration of hydrogen so that the effluent carbon oxides concentration is generally less than ten parts per million. This is accomplished due to the high rate of reaction of carbon dioxide in the presence of large excesses of hydrogen and low concentrations of water and methane. Both the carbon monoxide and carbon dioxide reactions are considered to be first order. In general, however, the rate of carbon monoxide methanation is substantially greater that the reaction rate of carbon dioxide by a factor of two to three times. As previously mentioned, in the typical gas composition encountered in the gasification of naphtha by the processes developed by the Gas Council of England, the carbon monoxide concentration is relatively low and the carbon dioxide concentration is relatively high. As has been pointed out previously by Humphries and Yarwood of the Gas Council in U.S. Pat. No.

3,511,624, it is of importance to maintain a surplus of carbon dioxide so that when the water-gas shift reaction comes to equilibrium, the surplus of carbon dioxide will help prevent an undesirable shift of the Boudouard equilibrium. The concentrations of the various constituents for each of these processes are tabulated in TABLE I below. The concentration of carbon dioxide, the hydrogen to carbon monoxide ratio and the steam to gas ratio for each process are of special interest.

TABLE I

| Typical Hydrogen Plant Methanation Gas | | Gas Council *Naphtha | Lurgi **(Coal) | Scrubbed Gas ***(Coal) | Modified by Recycled ***(Coal) |
|---|---|---|---|---|---|
| CO | 0.2 – 1.0 | 1.26 | 3.2 | 16 – 18 | 4.5 |
| $CO_2$ | .1 – 0.3 | 21.4 | 19.8 | 1 – 4 | 3.8 |
| $H_2$ | 92 – 98 | 22.3 | 23.6 | 60 – 65 | 22.8 |
| $CH_4$ | 0.5 – 3.0 | 55.0 | 51.6 | 14 – 16 | 68.9 |
| Steam/Gas | nil | .8 | .58 | nil | .43 |

*U.S. Patent 3,511,624 Humphries and Yarwood
**Moeller, F. W. Roberts, H. Britz, B Gas Processing, April, 1974
***Present Invention To obtain a product gas interchangeable with natural gas, the total concentration of hydrogen and carbon preferably would not exceed 6 mole %. However, since carbon dioxide is present, even in natural gas, it is acceptable within specified limits. Preferably, each of the constituents would not exceed 3 mole % of the total concentration and a concentration of about 1–2 % for each is preferred.

These limitations place a relatively narrow limit upon the initial carbon dioxide concentration and upon the $H_2$:CO ratio of the raw feed gas. The $H_2$:CO ratio in the raw feed gas should be in a range of from 3.0–3.6:1 and the carbon dioxide concentration should not exceed 3%. Various equilibrium values are tabulated in TABLE II below indicating in column 1 the initial concentration of carbon dioxide of the raw feed gas and in column 2, the $H_2$:CO ratio of the scrubbed feed gas prior to being admixed with the recycle product gas forming the inlet gas for the first stage of methanation. The third column indicates the concentration of hydrogen at the outlet of the secondary stage of methanation at a temperature of 650° F. and at 0.10 steam:gas ratio. The fourth. column, likewise, indicates the carbon dioxide concentration at the outlet of the secondary reactor under the same conditions.

TABLE II

| Scrubbed Feed Gas | | Approximate Secondary Outlet Outlet at 650° F. and 0.10 S/G | |
|---|---|---|---|
| Primary %$CO_2$ | Primary $H_2$:CO Ratio | %$H_2$ | %$CO_2$ |
| 2.0 | 3.1 | 1.13 | 4.21 |
| | 3.2 | 1.20 | 3.03 |
| | 3.3 | 1.32 | 1.86 |
| | 3.4 | 1.90 | 0.67 |
| | 3.5 | 3.80 | 0.01 |
| | 3.6 | 7.72 | Nil |
| 3.0 | 3.1 | 0.99 | 6.99 |
| | 3.2 | 1.05 | 5.76 |
| | 3.3 | 1.13 | 4.54 |
| | 3.4 | 1.24 | 3.40 |
| | 3.5 | 1.39 | 2.21 |
| | 3.6 | 1.62 | 1.18 |
| 4.0 | 3.1 | 0.87 | 10.7 |
| | 3.2 | 0.90 | 9.55 |
| | 3.3 | 0.91 | 8.40 |
| | 3.4 | 0.95 | 7.30 |
| | 3.5 | 1.04 | 6.20 |

TABLE II-continued

| Scrubbed Feed Gas | | Approximate Secondary Outlet Outlet at 650° F. and 0.10 S/G | |
|---|---|---|---|
| Primary %$CO_2$ | Primary $H_2$:CO Ratio | %$H_2$ | %$CO_2$ |
| | 3.6 | 1.12 | 3.92 |

It appears clear, in reviewing these equilibrium values at these conditions, therefore, that the $H_2$:CO ratio of the scrubbed feed gas must exceed 3:1 and should be less than 4:1. On the other hand, the carbon dioxide concentration in the raw feed gas should not exceed 4% and further the $H_2$:CO ratio must be increased as the carbon dioxide concentration is increased so as to maintain the outlet carbon dioxide and hydrogen concentration in the outlet gas within acceptable limits.

Steam, is, however, one of the most important parameters in the methanation of carbon monoxide and affects the system from many standpoints. First, as has been previously mentioned, steam reduces the thermodynamic potential for carbon deposition. Further, steam acts as a heat sink and thereby absorbs the heat of reaction, so as to depress the temperature rise for a given carbon monoxide concentration. On the other hand, due to equilibrium consideration, steam inhibits the methanation reaction and is a diluent for the reaction. We have proven experimentally, however, that steam must be present in the product gas and the inlet gas in order to carry on the reaction without carbon deposition. Further, we have found that within the acceptable range for the inlet concentration of carbon oxides, and within the maximum temperature rise acceptable within the first stage of methanation that sufficient steam can be produced in the first stage of methanation and be provided by the recycled gas from the first stage to carry on the process without accessory steam generating equipment. Generally speaking, a steam:gas ratio, in which all of the steam is provided by the recycle gas taken from the outlet of the first stage of methanation, should be within the range of 0.18–0.5:1.

The most important factor which influences the temperature rise, however, is the inlet concentration of carbon monoxide. This, more than any other factor, controls the temperature rise in the first stage of methanation. This is due to the extremely exothermic nature of the methanation reaction. Our studies have indicated that an outlet temperature in excess of 1050° F. causes aging and deactivation of the catalyst. However, an outlet temperature of 1000° F. may be tolerated for reasonable periods of upset operation. At an outlet temperature of 1000° F. the catalyst does age rapidly. Therefore, since recycling of the hot and wet gases from the first stage of methanation normally raises the carbon dioxide level, it is important that the carbon monoxide level be reduced so that the inlet carbon monoxide concentration in the mixed feed gases does not exceed 5.5%. Since the principal constituent of the recycled gas is methane, the methane concentration is simultaneously increased by a factor of about 4 while the carbon monoxide concentration of the raw feed is decreased by a factor of about 5. The $H_2$:CO ratio of the mixed gases should be at least 3:1 but should not exceed 6.5:1. Further, since carbon dioxide is generally produced in the first stage of methanation (due to the relatively high steam concentration) the recycled gas tends to increase the carbon dioxide concentration in the mixed gases.

The other important feature of the process is the catalyst utilized. We have found that some conventional nickel methanation catalysts are not suitable for this process due to the rigorous conditions under which the process is practiced. It is, of course, essential that an active catalyst is utilized. Due to the extremely exothermic nature of the reaction, the allowable temperature rise, dictated by the catalyst and by the tendency of the reaction $$CO + 3H_2 = CH_4 + H_2O$$

to move to the left at higher temperatures, limits the amount of carbon oxides allowable in the feed to the first stage of methanation. Further, we have found in order to initiate the methanation reaction at the lowest possible temperature, that a highly active catalyst should be utilized. It is, of course, clear, that initiation of an exothermic reaction at a low temperature allows for additional heat rise in the reactor and therefore increases the allowable concentration of reactants in the feed. Insofar as nickel catalysts are concerned, activity is almost directly proportional to the concentration of nickel up to about 60% by weight. Further catalysts containing less than 20% are generally too inactive. A preferable range of nickel concentration for this reaction is between 30 and 60 percent by weight of nickel.

The composition of the scrubbed gases produced with partial carbon dioxide removal after coal gasification is shown in Column 4 of TABLE I. It has been found, however, that such gases cannot be hydrogenated without excess temperature rise and/or formation of carbon and therefore, the composition must be modified in order to be utilized in a commercially feasible process. According to this invention, then, the product gases from the first stage of methanation are recycled to produce the modified gas composition shown in Column 5 of the TABLE I. It will be noted that the carbon dioxide concentration is relatively low both in the scrubbed gas and in the modified inlet gas relative to the carbon dioxide concentration found in the gas composition derived from gasification of naphtha and the composition of the feed gas proposed by Lurgi and Sasol in the April, 1974 publication.

Figure 2:
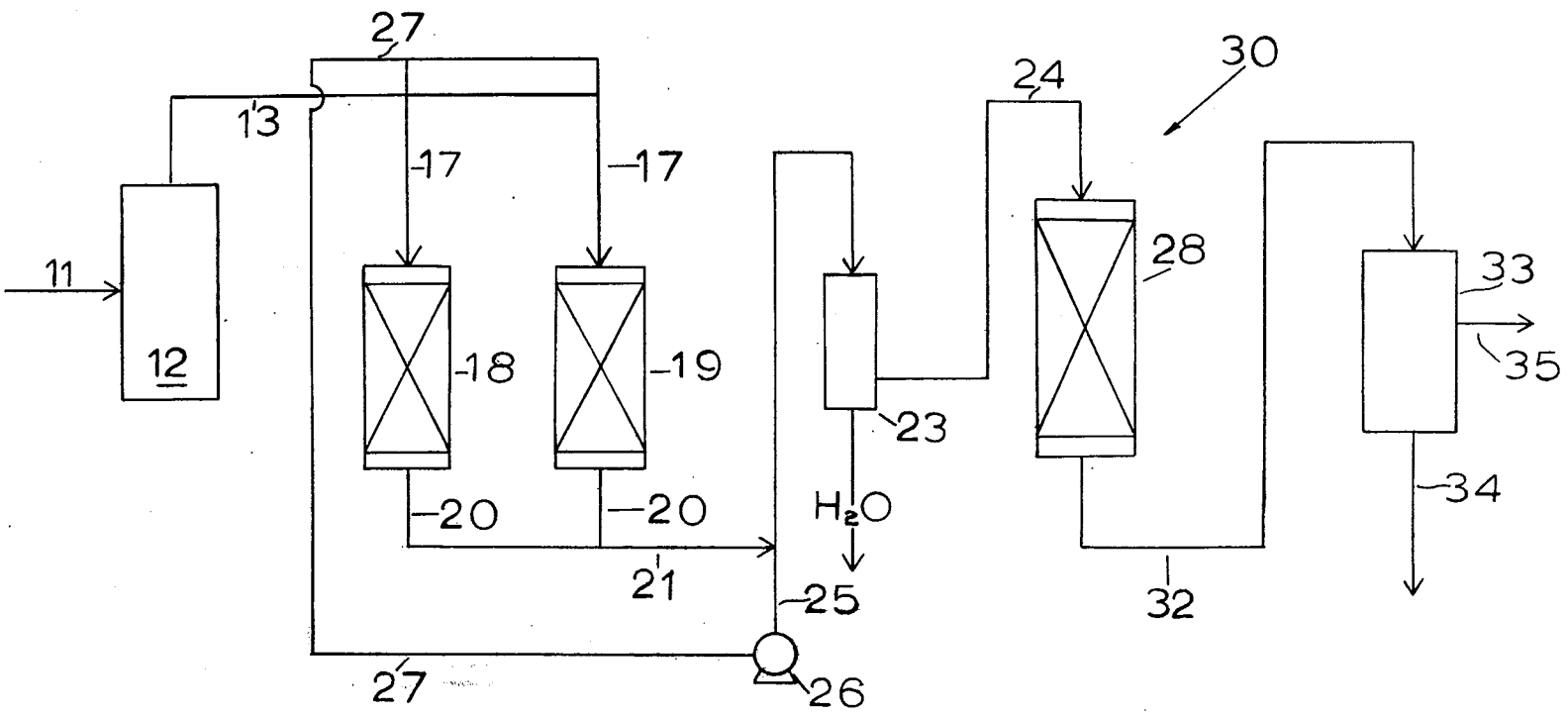
FIG. 2 is a schematic illustration of one embodiment of the present process taken from the right-hand side of the overall schematic illustration of FIG. 1 and showing the present process from the stage of carbon dioxide removal to the production of pipeline quality synthetic natural gas. In this drawing, the methanation stage indicated in FIG. 1 as 30 encompasses numerals 18–28.

With reference now to FIG. 1 the overall coal gasification and methanation enrichment processes are shown and are labeled as "PRIOR ART". According to the process, coal 1 is fed to a reactor whereby it is mixed into a slurry 2 which is then pumped via line 3 to a coal gasifier 4. The products of the gasification reaction are piped via line 5 to the solids removal step 6 whereby ash and tars are removed from the gases which are then lead via line 7 through line 8 to the carbon monoxide conversion step in water gas shift reactor 10. A portion of the gases, however, are fed via line 9 so that the mixture of hydrogen enriched gases coming from the shift reactor 10 are mixed in line 11 to go to the carbon dioxide removal stage 12. The acid gas removal stage must be done by a process that removes the sulfur compounds to very low levels. It can operate in one or several stages depending upon the degree of carbon dioxide removal desired prior to methanation. As is illustrated in FIG. 2, the sulfur removal is considered to be complete so that the scrubbed and purified gases are lead via line 13 to the parallel feed lines 17 to methanation reactors 18 and 19. If these gases have been subjected to acid gas scrubbing, their temperatures would be at something less than catalyst's reaction temperature thus requiring preheating to bring the gases up to temperatures of about 500° F. This is accomplished by cross exchange with the product gas and mixing the cold scrubbed gases with the hot and wet recycled gas via line 17 so as to bring the gases up to reaction temperature. The recycled gas provides steam for the proper control of equilibrium between carbon monoxide and carbon dioxide, and acts as a heat sink for the exothermic reaction and reduces and modifies the gas composition from that shown in Column 4 of TABLE I to that shown in TABLE II. Generally, a recycle to feed gas ratio of about 5:1 is sufficient to accomplish these purposes. Thereby, the gases going through the reactors 18 and 19 in parallel exit into two portions going via line 22 to the cooler 23 and all the way through line 24 to the final stage of methanation in methanation reactor 28. The other portion of the hot and wet gases go via line 25 to the recycle compressor 26 through recycle line 27 back to the parallel feed lines 17.

The cooled gases entering the final methanation reactor 28 react at a temperature of about 450°–500° F. and exit at a temperature of about 700° F. through line 32 and go from there to a gas cooler and dryer 33 where the water is removed through line 34 and the product gas goes via line 35 to the pipeline.

Figure 3:
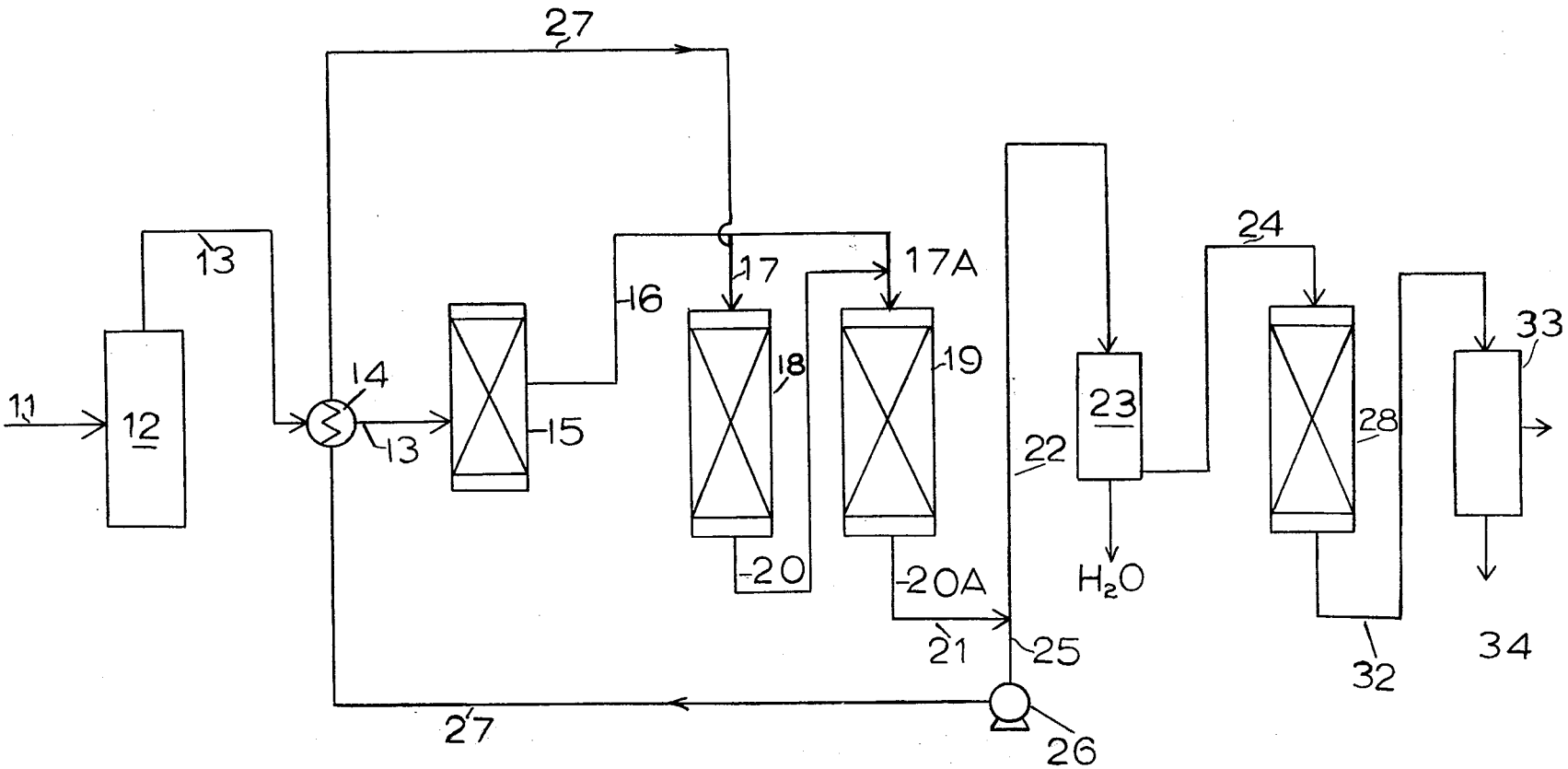
FIG. 3 illustrates another modification of the process shown in FIG. 2.

In FIG. 3, an alternate case is shown for upset conditions during $CO_2$ removal which results in sulfur compounds exiting in line 13. Thus, the gas in line 13 passing through heat exchanger 14 comes into indirect heat exchange relation with recycled gas through line 27 and is heated to the proper inlet temperature for the zinc oxide adsorbent in reactor 15. The purified gas exiting via line 16 as a sulfur free gas is at proper temperature for feeding by parallel lines 17 and 17A to the methanation reactors 18 and 19. In this modification, however, the product gas exiting in line 20 from reactor 18 goes via line 20 to dilute the feed gas in line 17A going to reactor 19 and the gas exiting from line 20A is fed through line 21 to be split between lines 22 and 25. The portion of the gases passing through line 25 goes to the recycle compressor 26 and thence through recycle line 27 back to line 17 to be mixed with the scrubbed feed going to reactor 18. Thereafter the gases exiting from the first reactor 18 are led serially via line 20 to parallel feed line 17A going to reactor 19 and are admixed with the scrubbed gases in parallel feed line 17A and thence into reactor 19. The gas from reactor 19 goes via line 20A to line 21 as previously indicated, to be split between lines 22 and 25. Since in this instance, the feed gas going from line 16 is equally divided into parallel feed lines 17 and 17A in the first and second reactors 18 and 19 of the first methanation stage respectively, the recycle rate through line 25 and recycle compressor 26 to recycle line 27 can be reduced relative to the recycle rate shown in the modification of FIG. 2. It will, of course, be obvious that the gases going through line 22 to cooler 23 and via line 24 to final methanation stage 28 operate identically to the system illustrated in FIG. 2.

EXAMPLE 1

The co-precipitated nickel and alumina catalysts were prepared as follows:

Solutions of nickel nitrate and aluminum nitrate were co-precipitated by addition of solution of sodium carbonate according to conventional techniques. After the solution had aged at 180° F. for an hour, the precipitate was washed to reduce the sodium concentration. The precipitate was dried at 350° F. and calcined at 600° F. Three percent graphite was added, and the precipitate was tableted and calcined at 600° F. The relative concentrations of the nickel nitrate and aluminum nitrate solutions were arranged so that in one instance specified as Catalyst A, the nickel concentration expressed as the metal was 60 percent by weight whereas in Catalyst B, the nickel concentration expressed as the metal was 50 percent, by weight.

EXAMPLE 2

In this instance, the nickel concentration of the nickel nitrate solution was calculated to produce catalyst comprising 50 percent by weight of nickel on kieselguhr. The kieselguhr was suspended in an aqueous solution of nickel nitrate and a sodium carbonate solution was added until a final pH of 7 to 7.2 was reached. The resulting precipitate was aged for 1 hour at 180° F. Thereafter, it was washed, decanted, reslurried and allowed to settle. The washed precipitate was washed again until the sodium was removed, and thereafter was dried at 350° F. and calcined at 600° F. Three percent graphite was added as a tableting aid and the material tableted and recalcined at 600° F. This catalyst was designated as Catalyst C.

EXAMPLE 3

This catalyst was a commercial catalyst which analyzed as 32 percent nickel, expressed as the metal. According to the information available, this catalyst was compounded with a carrier comprising cement, alumina and clay. This was designated as Catalyst D.

EXAMPLE 4

This catalyst was a commercial catalyst containing 32 percent nickel, expressed as the metal. According to the information available, this catalyst was prepared by precipitating nickel from a nitrate solution onto kieselguhr and after appropriate washing and drying was admixed with cement and clay and thereafter formed into tablets with the use of 3% graphite as a tableting aid. This catalyst was designated as catalyst E and had a relatively low surface area.

EXAMPLE 5

This catalyst, designated as catalyst F, again was a commercial catalyst and consisted of 32 percent nickel expressed as the metal. It was prepared by impregnating nickel nitrate onto a high surface area alumina pretreated with manganese oxide. Again, three percent graphite was added as a tableting aid and the catalyst after tableting was subjected to a final calcination to convert the nickel nitrate solution over to the oxide.

EXAMPLE 6

In this case, Catalysts D, E and F were tested utilizing a relatively dry gas to determine whether or not it would be possible to operate the first stage of the process without additional steam. A gas of the following compositions was mixed and set up in a bench unit to determine the feasibility of operating with a steam to gas ratio of less than 0.1. In these cases, it will be noted that the steam to gas ratio was actually 0.063 in one instance and 0.067 in another.

Because of the fact that these were bench scale units, i.e., operated under isothermal conditions rather than adiabatic conditions, the outlet temperature was not recorded. In each case, a substantial amount of carbon was formed. Thus, in the case of Catalyst D, after 120 hours on steam, the amount of carbon deposited was 22.0%. In the case of Catalyst E, after 60 hours on stream, the percentage of carbon on the catalyst was 0.7%. As for catalyst F, the percentage of carbon deposited on the catalyst after 150 hours on stream was 0.83%. The carbon analysis on these catalysts is obtained by analyzing a sample of the catalyst prior to putting it on stream and analyzing a sample of the catalyst after being on stream for the specified number of hours. The gain in carbon concentration is an indication of the amount of carbon deposition. Since graphite is used as a tableting aid, it is possible that the carbon concentration is less at the outlet than with the beginning sample. In any event, the carbon values reported are those in excess of the carbon concentration of the initial sample. Also, carbon was found in the effluent from the reactor. These conditions produced carbon in a very short period of time.

Carbon Formation with Low Steam - Dry Gas First Stage

This demonstrated a condition in which catalysts form carbon. The following tests were run with low steam.

EXAMPLE 7

In a pilot plant reactor system analogous to that illustrated in FIG. 2, catalyst A, was loaded to the first stage reactors 18 and 19 and catalyst C was loaded to the second stage reactor 28. Analyses were taken from the gas issuing from line 20 of these reactors and an inlet gas sample consisting of the mixed gases from reactors 18 and 19 was analyzed taken from line 24, going to reactor 28. For this reason, the inlet gas composition going to the second stage reactor 28 is not in exact correspondence with the outlet analyses of gases taken from lines 20 from one of the first stage reactors 18 or 19. Nevertheless, the feed gas in which the $H_2$:CO ratio had been adjusted between a ratio of 3:1 to 3.6:1 as fed to the first stage reactor. The feed was mixed with recycle gas in line 17 in a recycle:feed gas ratio of 4.1:1 to 5.5:1. The inlet temperature in the first stage was maintained at 500° to 550° F. at 350 PSIG and at space velocities of 15,000 to 20,000. The secondary reactor was run at 450° to 520° inlet temperature at 350 PSIG and at space velocities of 3000 to 10,000 per hour$^{-1}$. It will be noted that with a low steam:gas ratio in the inlet feed at 0.202 and a high carbon dioxide concentration was 12.20 producing a gas having a water-free gross heating value of 883 BTU:per cubic foot. The carbon dioxide concentration in the product gas was of such magnitude that it would be completely unsuitable for pipeline use without subsequent removal of the carbon dioxide.

Note: There are two first stage reactors feeding second stage so the outlet of first does not agree with inlet of second stage.

EXAMPLE 8

Operating under these same conditions, but adjusting the steam:gas ratio in the inlet feed to 0.453 and reducing the carbon dioxide in the inlet feed to 3.70, the data tabulated below was collected after 3270 hours of operation. It will be noted here that the carbon dioxide concentration of the product gas was 1.3% and the hydrogen concentration was 3.5 which is within satisfactory limits. The product gas had a water-free gross heating value of 984 BTU per cubic foot. The steam:-gas ratio in the inlet feed was relatively high, 0.453 to 1. Because of the low carbon dioxide in the scrubbed feed the carbon dioxide level in the product gas was well within satisfactory limits. The hydrogen concentration was approaching the unsatisfactory limit of 4.0. This illustrates that variation of the inlet feed and steam:gas ratio will produce a variation in the outlet constituents.

| | High Steam - Low $CO_2$ | | | | |
|---|---|---|---|---|---|
| | | First Stage | | Second Stage | |
| Catalyst | Fresh Feed | B | | C | |
| | | Inlet | Outlet | Inlet | Outlet |
| R/F | | 5.37 | | | |
| $\%H_2$ | 68.00 | 25.00 | 12.00 | 14.20 | 3.50 |
| %CO | 20.80 | 4.83 | 0.11 | 0.12 | 0.01 |
| $\%CO_2$ | 1.72 | 3.70 | 3.90 | 4.20 | 1.30 |
| $\%CH_4$ | 9.40 | 67.40 | 84.00 | 82.50 | 96.00 |
| Steam/Gas | .0024 | .453 | 0.523 | 0.046 | 0.112 |
| Temperature (degrees F) | | 529 | 854 | 470 | 678 |
| Pressure (psig) | | 348 | — | 346 | — |
| Space Velocity ($m^{-1}$) | | 18,000 | — | 7900 | — |
| Water Free Gross Heating Value 984 | | | | | |

EXAMPLE 9

Operating again under the same general conditions, but varying the carbon dioxide concentration in the fresh feed to 4.3% and lowering the steam concentration to a steam:gas ratio of 0.381, it will be noted that the carbon dioxide concentration in the product gas was above the desired limit of 6.70. This was true even though the water-free gross heating value of the product gas was 958 BTU per cubic foot. It will be noted that with the steam:gas ratio as indicated, the initial carbon dioxide concentration was 4.3% which, due to the shift reaction in the initial stage, resulted in an inlet concentration of carbon dioxide of 7.3%. We have found that the initial carbon dioxide concentration of the scrubbed feed should not exceed 4% since the carbon dioxide added because of the recycle gas increases that going to the first stage above acceptable limits. Consequently, carbon dioxide concentration in the outlet of the secondary is beyond acceptable limits in that the gas would require further scrubbing for carbon dioxide removal.

| | High Steam - High $CO_2$ | | | | |
|---|---|---|---|---|---|
| | | First Stage | | Second Stage | |
| Catalyst | Fresh Feed | Inlet | Outlet | Inlet | Outlet |
| | | B | | C | |
| R/F | | 5.02 | | | |
| $\%H_2$ | 65.80 | 20.20 | 8.30 | 8.20 | 0.10 |
| %CO | 21.00 | 4.90 | 0.11 | 0.12 | 0.01 |
| $\%CO_2$ | 4.30 | 7.30 | 8.10 | 8.00 | 6.70 |
| $\%CH_4$ | 9.90 | 70.90 | 85.30 | 84.90 | 94.50 |
| Steam/Gas | 0.0024 | 0.381 | 0.498 | 0.002 | 0.048 |
| Temperature (degrees F) | | 565 | 858 | 482 | 645 |
| Pressure (psig) | | 352 | | 340 | |
| Space Velocity ($m^{-1}$) | | 19,034 | | 6500 | |
| Water Free Gross Heating Value 958 | | | | | |

EXAMPLE 10

To illustrate catalyst activity and stability a 1000 hour life test and 4000 hour life test were run. In these life tests, catalysts A and B were studied in the first stage of methanation. The second stage in one case contained catalyst B and in the other catalyst C.

A. 4000 hour Life Test — Hour 1558

| | | First Stage | | Second Stage | |
|---|---|---|---|---|---|
| Feed Catalyst | | Inlet | Outlet | Inlet | Outlet |
| | | B | | C | |
| R/F | | 5.25 | | | |
| $\%H_2$ | 72.00 | 22.80 | 10.10 | 11.40 | 0.60 |
| %CO | 18.80 | 4.30 | 0.11 | 0.13 | 0.03 |
| $\%CO_2$ | 2.30 | 5.00 | 5.00 | 5.30 | 3.00 |
| $\%CH_4$ | 8.90 | 69.30 | 84.60 | 83.00 | 94.70 |
| Steam/Gas | .0024 | 0.420 | 0.563 | 0.053 | 0.088 |
| Temp. (F) | | 546 | 839 | 463 | 650 |
| Press (psig) | | 350 | | 335 | |
| S. V. ($m^{-1}$) | | 17,200 | | 3200 | |
| Water Free Gross Heating Value 962 | | | | | |

B. 4000 hour Life Test — Hour 4010

| | | First Stage | | Second Stage | |
|---|---|---|---|---|---|
| Feed Catalyst | | Inlet | Outlet | Inlet | Outlet |
| | | B | | C | |
| R/F | | 5.38 | | | |
| $\%H_2$ | 68.20 | 24.60 | 12.40 | 13.00 | 1.90 |
| %CO | 19.80 | 4.60 | 0.12 | 0.15 | 0.02 |
| $\%CO_2$ | 2.90 | 5.00 | 5.20 | 5.30 | 3.00 |
| $\%CH_4$ | 9.10 | 65.00 | 82.50 | 81.00 | 95.10 |
| Steam/Gas | .0024 | 0.447 | 0.655 | 0.024 | 0.119 |
| Temp. (F) | | 530 | 852 | 490 | 662 |
| Press (psig) | | 350 | | 340 | |
| S. V. ($m^{-1}$) | | 17,400 | | 4900 | |
| Water Free Gross Heating Value 970 | | | | | |

C. 1000 hour Life Test — Hour 475

| | | First Stage | | Second Stage | |
|---|---|---|---|---|---|
| Feed Catalyst | | Inlet | Outlet | Inlet | Outlet |
| | | A | | A | |
| R/F | | 4.75 | | | |
| $\%H_2$ | 69.10 | 23.80 | 11.00 | 11.40 | 1.00 |
| %CO | 20.50 | 5.00 | 0.12 | 0.13 | 0.04 |
| $\%CO_2$ | 2.10 | 4.80 | 5.20 | 5.30 | 2.60 |
| $\%CH_4$ | 8.30 | 69.00 | 85.40 | 85.00 | 96.40 |
| Steam/Gas | .0024 | 0.379 | 0.531 | 0.018 | 0.096 |
| Temp (F) | | 530 | 850 | 485 | 641 |
| Press (psig) | | 352 | | 339 | |
| S. V. | | | | | |

-continued

| Feed<br>Catalyst | First Stage<br>Inlet<br>A | <br>Outlet | Second Stage<br>Inlet<br>A | <br>Outlet |
|---|---|---|---|---|
| ($m^{-1}$) | 18,274 | | 3700 | |

Note:
In all cases second stage inlet has other first stage outlets mixed.

D. 1000 hour Life Test — Hour 932

| Feed<br>Catalyst | | First Stage<br>Inlet<br>A | <br>Outlet | Second Stage<br>Inlet<br>A | <br>Outlet |
|---|---|---|---|---|---|
| R/F | | 4.52 | | | |
| %$H_2$ | 67.70 | 22.80 | 9.80 | 9.70 | 0.20 |
| %CO | 19.80 | 4.80 | 0.13 | 0.12 | 0.05 |
| %$CO_2$ | 3.00 | 5.10 | 5.70 | 5.50 | 3.70 |
| %$CH_4$ | 9.50 | 71.80 | 86.80 | 86.60 | 96.50 |
| Steam/Gas | .0024 | 0.417 | 0.507 | 0.012 | 0.073 |
| Temp (F) | | 526 | 842 | 494 | 650 |

EXAMPLE 11

The recycle to fresh feed ration was varied in a series of tests to obtain outlet temperatures of 1000° and 1100° F. The compositions and product gases are shown below:

Conditions

| Recycle to Feed Ratio - R/F | Inlet | Outlet | Inlet | Outlet |
|---|---|---|---|---|
| Temperature (F) | 555 | 1001 | 602 | 1112 |
| Pressure (psig) | 352 | | 352 | |
| Space Velocity | 16,157 | | 13,644 | |
| R/F | 4.06 | | 3.47 | |
| Gas Composition | | | | |
| %$H_2$ | 34.30 | 19.20 | 33.50 | 22.10 |
| %CO | 5.20 | 0.45 | 7.50 | 2.05 |
| %$CO_2$ | 5.90 | 6.70 | 7.70 | 9.40 |
| %$CH_4$ | 56.80 | 74.80 | 52.20 | 66.20 |
| Steam/Gas | 0.320 | 0.446 | 0.200 | 0.367 |

After each condition the catalyst was returned to the normal operating range.

| Conditions | After 1000 F<br>Inlet | <br>Outlet | After 1100 F<br>Inlet | <br>Outlet |
|---|---|---|---|---|
| Temperature (F) | 527 | 863 | 545 | 835 |
| Pressure (psig) | 352 | | 352 | |
| Space Velocity | 18,390 | | 18,697 | |
| R/F | 4.42 | | 5.25 | |

-continued

| Conditions | After 1000 F<br>Inlet | <br>Outlet | After 1100 F<br>Inlet | <br>Outlet |
|---|---|---|---|---|
| Gas Compositions | | | | |
| %$H_2$ | 24.60 | 12.00 | 20.40 | 6.80 |
| %CO | 5.00 | 0.10 | 4.80 | 0.14 |
| %$CO_2$ | 5.30 | 5.10 | 6.60 | 7.50 |

| Catalyst | Low Steam - High $CO_2$<br>Gas Compositions<br>Fresh Feed | First Stage<br>Inlet | <br>Outlet<br>B | Second Stage<br>Inlet | <br>Outlet<br>C |
|---|---|---|---|---|---|
| R/F* | | 6.31 | | | |
| %$H_2$ | 61.20 | 16.80 | 4.20 | 6.90 | 0.30 |
| %CO | 16.00 | 3.00 | 0.13 | 0.49 | 0.06 |
| %$CO_2$ | 7.72 | 11.40 | 11.80 | 12.20 | 12.20 |
| %$CH_4$ | 15.20 | 68.50 | 84.00 | 80.00 | 87.00 |
| Steam/Gas | .0024 | 0.202 | 0.296 | 0.003 | 0.05 |
| Temperature (degrees F) | | 505 | 788 | 502 | 612 |
| Pressure (psig) | | 352 | | 330 | |
| Space Velocity** | | 13,400 | | 22,100 | |
| Water Free Gross Heating Value 883 BTU/Cu. Ft. | | | | | |

*Recycle to Feed Gas Ratio
**Vol/Vol per hour

| | Catalyst D<br>In | <br>Out | Catalyst E<br>In | <br>Out | Catalyst F<br>In | <br>Out |
|---|---|---|---|---|---|---|
| %$H_2$ | 12.40 | 0.43 | 13.40 | 0.42 | 17.70 | 1.85 |
| %CO | 3.12 | 0.01 | 2.83 | 0.01 | 3.27 | 0.01 |
| %$CO_2$ | 3.18 | 3.92 | 4.30 | 4.23 | 2.17 | 2.39 |
| %$CH_4$ | 81.30 | 95.64 | 79.47 | 95.34 | 77.86 | 95.75 |
| Steam/Gas | 0.063 | — | 0.067 | | | |
| Temp (F) | 604 | | 598 | | | |
| Press (psig) | 475 | | 475 | | | |
| S. V. (hr-1) | 15,400 | | 12,400 | | | |
| Hours on Stream | 120 | | 60 | | 150 | |
| %C Deposited | 22.0% | | 0.7% | | 0.83% | |
| Press (psig) | | 352 | | 341 | | |
| S. V. (hr-1) | | 18,100 | | 4600 | | |
| Water Free Gross Heating Value 979 | | | | | | |

It will be noted that in each of the tests during the 4000 hour pilot plant test and the 1000 hour pilot plant test that a product gas in excess of 940 BTU per cubic foot was consistently produced and that the hydrogen and $CO_2$ concentrations in the product gas was in all cases well within acceptable limits. The reaction occurred in the top 40% of the bed and the temperature profile was such that the expected life of the catalyst would be well in excess of 2 years.

| | | | | |
|---|---|---|---|---|
| %$CH_4$ | 68.90 | 85.10 | 69.50 | 86.00 |
| Steam/Gas | 0.411 | 0.519 | 0.460 | 0.506 |

The conversion of CO to $CH_4$ before and after 1000° F are almost identical. A loss in conversion was observed after 1100° F indicating some aging at this temperature.

The aging that was observed in this test was movement of the temperature profile out of the top 40% of the bed. In other words, the catalyst which had been subjected to 1000° F, continued to function identically as previously within the top 40% of the bed. Whereas with the catalyst which has been subjected to a temperature of 1100° F, the temperature profile had moved down to 54% of the bed. Our studies have shown that upsets in the outlet of up to 1050° can be tolerated without substantial aging. It is, of course, possible during the course of the reaction to raise the temperature as the catalyst begins to deactivate. However, due to the extreme exothermic nature of these reactions and due to the fact that the catalyst will continue to deactivate if certain temperatures are exceeded, and further that the equilibrium values will tend to shift in an undesirable direction if certain temperatures are exceeded, this expedient can only be utilized in the terminal ages of the catalyst's life. In any event, our researches have shown that a catalyst life in excess of 2 years can be expected with the catalyst of this invention under the process conditions set forth.

In Example 10, the carbon of the catalyst both in the first stage and second stage methanators were analyzed prior to and after several hours of operation. In no case was an undesirable amount of carbon found. In one case, catalyst B after 4000 hours of operation in the first stage of methanation had actually shown a loss of 0.9% carbon whereas catalyst C in the second stage of the reactor after 4000 hours had shown only a gain of 0.1% carbon. The highest carbon gain was 1.3% after 1200 hours. This data shows conclusively that carbon formation on the catalyst under the conditions specified in this process is not a problem.

Many modifications will occur to those skilled in the art from the detailed description and the examples hereinabove given which are meant to be exemplary in nature and nonlimiting except so as to be commensurate in scope with the appended claims.

We claim:

1. A process for the catalytic enrichment of a scrubbed feed gas, derived from the gasification of coal, and which has been scrubbed for the partial removal of carbon dioxide which includes the methanation of carbon oxides in multiple stages to produce a methane rich gas of pipeline quality, in which, A. said scrubbed feed gas comprises hydrogen, methane and carbon oxides, the carbon oxides being present in a concentration of from 15 to 25 mole %, the carbon dioxide representing less than 4% of the said scrubbed gas and said hydrogen being present in at least a stochiometric amount sufficient to produce a minimum $H_2$:CO ratio of 3:1, and a maximum $H_2$:CO ratio no greater than 4:1;

B. the improvement which includes reacting hydrogen and carbon oxides over a highly active catalyst in a first methanation stage to produce methane and steam at an inlet temperature sufficiently high to initiate the methanation reaction and at an outlet temperature no greater than 1050° F. to produce a hot and wet product gas and C. recycling a portion of said hot and wet product gas to said scrubbed feed gas at such a rate to provide a ratio of recycle to feed gas of no greater than 5:1 and mixing said recycled portion of said hot and wet gas therewith in sufficient volume to produce a mixed inlet gas having a steam to gas ratio of between 0.18–0.45:1, thereby:

1. supplying heat to the scrubbed gas to bring said gas up to reaction temperature,
2. supplying steam to said gas to prevent carbon deposition on the catalyst during the first stage of methanation and to absorb the exothermic heat of reaction and
3. modifying the gas composition so as to bring said composition out of the carbon forming range by reducing the monoxide concentration to a level of less than 5.5% while simultaneously increasing the methane concentration by a factor in excess of 4;

D. thereafter cooling the remaining portion of said product gas to a temperature of from 450° to 600° F., E. reacting the residual carbon oxides and hydrogen in a final methanation stage over a highly active catalyst at an inlet temperature at least sufficiently high to initiate the methanation reaction and at an outlet temperature of no greater than 850° F. to complete the methanation reaction and to reduce the residual hydrogen and carbon dioxide to a level of less than 6 mole %; and F. cooling the gases from said final methanation stage to remove water therefrom and thereby produce a dry, methane rich gas having a gross heating value in excess of 940 BTU per cubic foot and a residual hydrogen and carbon dioxide concentration of less than 6 mole %.

2. A process, as defined in claim 1, in which said catalyst for said first stage of methanation comprises a coprecipitated nickel-alumina catalyst containing nickel expressed as metal of at least 30% by weight.

3. A process, as defined in claim 1, in which said catalyst of said final stage of methanation comprises nickel precipitated on a silica support, said nickel being present in a concentration expressed as metal of at least 30%.

4. A process, as defined in claim 1, in which the first stage of methanation is carried out in at least two reactors connected in parallel and in which product gases from both reactors are recycled hot and are admixed with said feed gases entering each of said reactors.

5. A process, as defined in claim 1, in which said first stage of methanation is carried out in at least two reactors in series.

6. A process, as defined in claim 1, the further combination of removing sulfur bearing impurities from said scrubbed feed gases which comprises A. passing said feed gases through a bed of zinc oxide absorbent at a temperature of 500° to 700° F., B. the improvement of passing said recycled hot and wet gases into indirect heat exchange with said scrubbed feed gases to supply heat to said scrubbed feed gases entering said bed of zinc oxide adsorbent prior to admixing said recycled gas with said feed gas going to said first of methanation.

7. A process, as defined in claim 1, in which the volume of hot and wet product gas recycled is of sufficient volume relative to said scrubbed feed gas to raise the temperature of the mixed inlet gas to a range of from 450°–550° F.

8. A process, as defined in claim 1, the improvement which comprises regulating the composition of said scrubbed feed gas so that as the carbon dioxide concentration increases $H_2$:CO ratio is increased.

9. A process, as defined in claim 1, the improvement of regulating the composition of said scrubbed feed gas so that when the carbon dioxide concentration of said feed gas is less than 3%, the $H_2$:CO ratio is less than 3.6.

10. A process, as defined in claim 1, the improvement of regulating the composition of said scrubbed feed gas so that when the carbon dioxide concentration is in excess of 3% the $H_2$:CO ratio is greater than 3.3.

11. A process, as defined in claim 1, the improvement of regulating the composition of said scrubbed feed gas so that when the carbon dioxide concentration of said mixed inlet feed gas is in excess of 4% the $H_2$:CO ratio is greater than 3.6:1.

* * * * *